US010220483B2

(12) United States Patent
Hu et al.

(10) Patent No.: US 10,220,483 B2
(45) Date of Patent: Mar. 5, 2019

(54) SUBSTRATE GRINDING DEVICE

(71) Applicants: BOE Technology Group Co., Ltd., Beijing (CN); Beijing BOE Display Technology Co., Ltd., Beijing (CN)

(72) Inventors: Weiqin Hu, Beijing (CN); Changxu Chen, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 30 days.

(21) Appl. No.: 15/522,862

(22) PCT Filed: May 13, 2016

(86) PCT No.: PCT/CN2016/082023
§ 371 (c)(1),
(2) Date: Apr. 28, 2017

(87) PCT Pub. No.: WO2017/133124
PCT Pub. Date: Aug. 10, 2017

(65) Prior Publication Data

US 2018/0056471 A1 Mar. 1, 2018

(30) Foreign Application Priority Data

Feb. 2, 2016 (CN) ..... 2016 2 0107882

(51) Int. Cl.
*B24B 7/22* (2006.01)
*B24B 37/10* (2012.01)
(Continued)

(52) U.S. Cl.
CPC ..... *B24B 7/228* (2013.01); *B24B 37/10* (2013.01); *B24B 37/105* (2013.01);
(Continued)

(58) Field of Classification Search
CPC ..... B24B 37/10; B24B 37/105; B24B 37/34; B24B 7/228; B24B 57/02
(Continued)

(56) References Cited

U.S. PATENT DOCUMENTS 4,656,791 A * 4/1987 Herrington ..... B24C 1/045 451/38
4,703,591 A * 11/1987 Herrington ..... B24C 1/045 451/40

(Continued)

FOREIGN PATENT DOCUMENTS

| | | |
|---|---|---|
| CN | 103128628 | 6/2013 |
| CN | 104647193 | 5/2015 |
| CN | 105033839 | 11/2015 |

OTHER PUBLICATIONS

International Search Report and Written Opinion, including English translation of Box No. V of the Written Opinion, for International Application No. PCT/CN2016/082023, dated Oct. 31, 2016.

*Primary Examiner* — George B Nguyen
(74) *Attorney, Agent, or Firm* — Westman, Champlin & Koehler, P.A.

(57) ABSTRACT

The present application has disclosed a substrate grinding device, which includes a carrying platform, a lifting platform and a grinding head, the lifting platform is located above the carrying platform and configured to be movable in a direction perpendicular to an upper surface of the carrying platform with respect to the carrying platform upwardly or downwardly; and the grinding head is mounted to the lifting platform and configured to grind a grind region of a substrate to be ground disposed on the carrying platform, the grind region being a region of the substrate where there is a partial scratch.

13 Claims, 4 Drawing Sheets

(51) Int. Cl.
*B24B 41/047* (2006.01)
*B24B 57/02* (2006.01)
*B24B 37/34* (2012.01)

(52) U.S. Cl.
CPC ..... *B24B 41/047* (2013.01); *B24B 57/02* (2013.01); *B24B 37/34* (2013.01)

(58) Field of Classification Search
USPC ..... 451/63, 66, 75
See application file for complete search history.

(56) References Cited

U.S. PATENT DOCUMENTS 5,099,618 A * 3/1992 Schmid ..... G11B 7/0037 451/150
5,349,788 A * 9/1994 Nedo ..... B26F 3/008 451/75
5,409,418 A * 4/1995 Krone-Schmidt ..... B08B 6/00 451/102
5,423,713 A * 6/1995 Mishima ..... B24C 1/04 451/102
5,542,874 A * 8/1996 Chikaki ..... B24B 37/105 451/158
5,964,650 A * 10/1999 Born ..... B24D 13/02 451/526
6,036,584 A * 3/2000 Swinkels ..... B24C 1/04 451/102
6,361,647 B1 * 3/2002 Halley ..... B24B 37/042 156/345.1
6,450,859 B1 * 9/2002 Moyer ..... B24B 7/228 409/187
6,592,435 B2 * 7/2003 Kishima ..... B24B 1/00 451/303
2003/0092364 A1 * 5/2003 Erickson ..... B24C 1/045 451/75
2003/0096562 A1 * 5/2003 Kurogouchi ..... B24C 1/08 451/66
2003/0100196 A1 5/2003 Lai et al.
2014/0170935 A1 * 6/2014 Maurer ..... B24C 3/04 451/8
2015/0283662 A1 * 10/2015 Bossoni ..... B23K 37/0461 219/121.79

* cited by examiner

SUBSTRATE GRINDING DEVICE

CROSS REFERENCE TO RELATED APPLICATIONS

This application is a Section 371 National Stage Application of International Application No. PCT/CN2016/082023, filed on 13 May 2016, entitled "SUBSTRATE GRINDING DEVICE", which claims priority to Chinese Application No. 201620107882.6, filed on 2 Feb. 2016, incorporated herein by reference in its entirety.

TECHNICAL FIELD

The present disclosure relates to the field of manufacturing technology of display devices, and specially, to a substrate grinding device.

BACKGROUND

Currently, a display device usually includes a substrate which has a very high requirement on surface accuracy thereof to prevent adverse affect on picture display quality of the display device due to insufficient surface accuracy of the substrate (such as, scratches, foreign substances or the like on the surface of the substrate). However, during manufacturing of a display device, for example, when a substrate is being transferred, surface of the substrate may be easily scratched locally, i.e., partial scratches may be generated on the surface of the substrate.

In order to remove partial scratches on surface of a substrate to improve picture display quality of the display device, presently and usually, a substrate grinding device is utilized to perform an entire grinding on the surface of the substrate where partial scratches lie, so as to remove the partial scratches on the surface of the substrate and improve picture display quality of the display device. However, removing partial scratches on the surface of the substrate in the above manner will reduce an overall thickness of the substrate, and if the substrate having a reduced thickness is assembled in a display device, assembling accuracy of the display device is reduced.

SUMMARY

An object of the present disclosure is to provide a substrate grinding device, which may solve the technical problem of reduced assembling accuracy of the display device due to reduced overall thickness of the substrate caused by using an existing technical solution to remove partial scratch on the surface of the substrate.

In order to achieve the above object, there is provided a substrate grinding device, which includes: a carrying platform; a lifting platform located above the carrying platform and configured to be movable in a direction perpendicular to an upper surface of the carrying platform upwardly or downwardly; and a grinding head mounted to the lifting platform and configured to grind a grind region of a substrate to be ground disposed on the upper surface of the carrying platform, the grind region being a region of the substrate where there is a partial scratch.

When the substrate grinding device according to the present disclosure is utilized to remove partial scratches on surface of a substrate to be ground, a grind region of the substrate is ground by a grinding head. In other words, the substrate grinding device according to the present disclosure may only grind a partial region of a surface of a substrate to remove partial scratches on the surface of the substrate. Compared with the solution of decreasing an overall thickness of a substrate when partial scratch on a surface of the substrate is removed by an existing technique, by means of the substrate grinding device according to the present disclosure being utilized to remove partial scratches on a surface of a substrate, an overall decrease of the thickness of the substrate may be prevented and assembling accuracy of a display device may be improved.

BRIEF DESCRIPTION OF THE DRAWINGS

The accompanying drawings, which form a part of the application, are provided to help understand the technical solutions of the disclosure, and exemplary embodiments of the disclosure and their descriptions are provided to explain the technical solutions of the disclosure and should not be construed as being a limitation to the present disclosure. In the drawings.

DETAILED DESCRIPTION OF PREFERRED EMBODIMENTS

In order to further set forth the substrate grinding device provided in embodiments of the present disclosure, detailed descriptions are provided hereinafter in conjunction with the accompanying drawings.

Referring to FIGS. 1 to 4, a substrate grinding device provided according to an exemplary embodiment of the present disclosure includes a carrying platform 10, a lifting platform 20 and a grinding head 30. The lifting platform 20 is located above the carrying platform 10 and may be moved upwards or downwards in a direction perpendicular to an upper surface of the carrying platform 10 with respect to the carrying platform 10. The grinding head 30 is mounted to the lifting platform 20 and may be used to grind a grind region of a substrate to be ground disposed on the carrying platform 10. The grind region is a region of the substrate to be ground where there is partial scratch.

Figure 1:
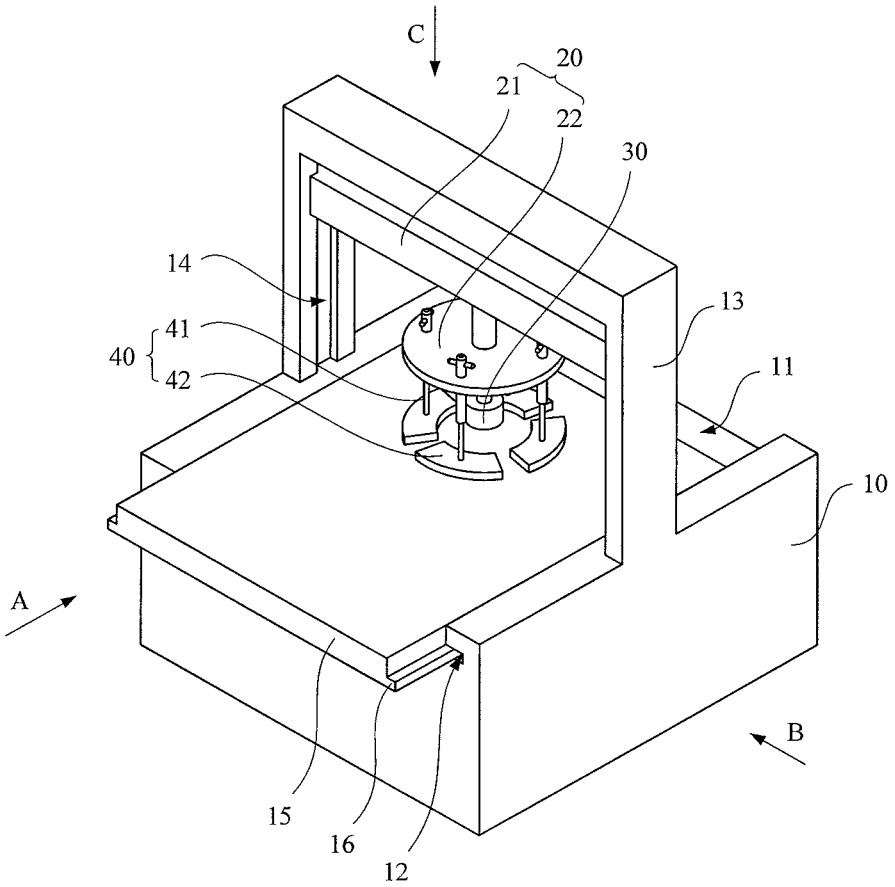
FIG. 1 is an illustrative view showing a structure of a substrate grinding device according to an exemplary embodiment of the present disclosure.

For example, as shown in FIG. 1, the upper surface of the carrying platform 10 is a horizontal surface, and the lifting platform 20 is located above the carrying platform 10 and may be moved upwards or downwards in a direction perpendicular to the upper surface of the carrying platform 10. That is, the lifting platform 20 may reciprocate in the vertical direction, or in other words, the lifting platform 20 may reciprocate in the up and down directions shown in FIG. 1. The grinding head 30 is mounted to the lifting platform 20, and when the lifting platform 20 is moving upwards or downwards in the direction perpendicular to the upper surface of the carrying platform 10, the grinding head 30 also moves upwards or downwards in the direction perpendicular to the upper surface of the carrying platform 10 along with the lifting platform 20.

When the above described substrate grinding device is utilized to remove partial scratch in the surface of the substrate to be ground, at first, the substrate to be ground may be disposed on the upper surface of the carrying platform 10, and the grind region of the substrate to be ground is aligned with a grinding surface 32 of the grinding head 30, where the grind region of the substrate to be ground is a region of the substrate to be ground where partial scratch exists, i.e., the region which needs to be ground partially; then the lifting platform 20 is moved in the direction perpendicular to the upper surface of the carrying platform 10 towards the carrying platform 10, moving the grinding head 30 in the direction perpendicular to the upper surface of the carrying platform 10 towards the carrying platform 10; when the grinding surface 32 of the grinding head 30 contacts the substrate to be ground, the lifting platform 20 is stopped to move towards the carrying platform 10; then the grinding head 30 is used to grind the grind region of the substrate to be ground, removing the partial scratch on the surface of the substrate.

It can be understood from the above that, when the substrate grinding device according to the embodiment of the present disclosure is used to remove partial scratch on a surface of a substrate to be ground, the grinding head 30 grinds a grind region of the substrate, that is, the substrate grinding device according to the embodiment of the present disclosure may only grind a partial region of the surface of the substrate to be ground to remove the partial scratch on the surface of the substrate to be ground. Therefore, as compared with the prior art in which an overall thickness of the substrate to be ground is reduced when the partial scratch on the surface of the substrate is removed, the substrate grinding device provided according to the embodiment of the present disclosure may prevent the overall thickness of the substrate from being reduced when it is used to remove the partial scratch, thus, assembling accuracy of a display device may be improved.

Additionally, when a partial scratch on a surface of a display substrate that has been assembled needs to be removed and an existing technique is used to remove the partial scratch on the surface of the display substrate, an existing substrate grinding device will grind the entire surface of the display substrate where the partial scratch lies to remove the partial scratch, and usually, a printed circuit board (PCB) on the display substrate will be ground at the same time, because the PCB has already been disposed on at least one side of the display substrate that has been assembled. Thus, the PCB will interfere the grinding and be adversely affected. However, when the substrate grinding device according to the embodiment of the present disclosure is used to remove the partial scratch on the surface of the display substrate, only a region of the surface of the display substrate having the partial scratch will be ground, and the PCB will not be ground, thus, the PCB will not interfere the grinding and will not be adversely affected.

To be noted, when grind regions of a substrate to be ground have different areas or sizes are to be ground by using the above substrate grinding device, grinding heads 30 having grinding surfaces 32 of corresponding areas or sizes can be selected, based on the areas or sizes of the grind regions of the substrate to be ground. In other words, the grinding surfaces 32 of the selected grinding heads 30 have areas or sizes matching the areas or sizes of the grind regions of the substrate to be ground, so that the substrate to be ground having grind regions of different areas or sizes can be ground to remove scratches on the surface of the substrate, and applicability of the substrate grinding device is improved.

After removing partial scratches on the surface of the substrate to be ground by using the substrate grinding device provided according to the above embodiment, a thickness of a region of the substrate corresponding to the grind region will be decreased. In an experiment, a polarizing film is attached to the substrate that has been ground to remove its partial scratches, no air bubbles are generated between the substrate and the polarizing film, and no change of transmissivity of light is observed. That is, performance of the substrate has not been adversely affected after removing partial scratches on the surface of the substrate by using the substrate grinding device according to the embodiment.

Still referring to FIG. 1, in this embodiment, up-down guiding pillars 13 perpendicular to the upper surface of the carrying platform 10 are provided at edges of the upper surface of the carrying platform 10; the lifting platform 20 is mounted on the up-down guiding pillars 13, and the lifting platform 20 may move upwards or downwards in a length direction of the up-down guiding pillars 13. In practice, the upper surface of the carrying platform 10 is a horizontal surface, the up-down guiding pillars 13 are vertically disposed at the edges of the upper surface of the carrying platform 10; the lifting platform 20 is mounted on the up-down guiding pillars 13, and the lifting platform 20 may move upwards or downwards in the length direction of the up-down guiding pillars 13. For example, vertical slideways 14 or lifting rails may be provided on the up-down guiding pillars 13 along the length direction of the up-down guiding pillars 13, the lifting platform 20 is provided with sliders mounted in the vertical slideways 14 or on the lifting rails; when the lifting platform 20 is moved upwards or downwards in the length direction of the up-down guiding pillars 13, the grinding head 30 is also moved upwards or downwards.

In order to improve reliability and stability of the lifting platform 20 when it moves upwards or downwards in the length direction of the up-down guiding pillars 13, in the embodiment shown in FIG. 1, for example, the upper surface of the carrying platform 10 has a rectangular shape, the number of the up-down guiding pillar 13 is two and the two up-down guiding pillars 13 are located at two opposite edges of the upper surface of the carrying platform 10; the lifting platform 20 includes a supporting beam 21, the grinding head 30 is mounted to the supporting beam 21; two ends of the supporting beam 21 are mounted to the two up-down guiding pillars 13 respectively. The supporting beam 21 is connected to a driving device, which drives the supporting beam 21 to move upwards or downwards in the length direction of the up-down guiding pillars 13.

Figure 2:
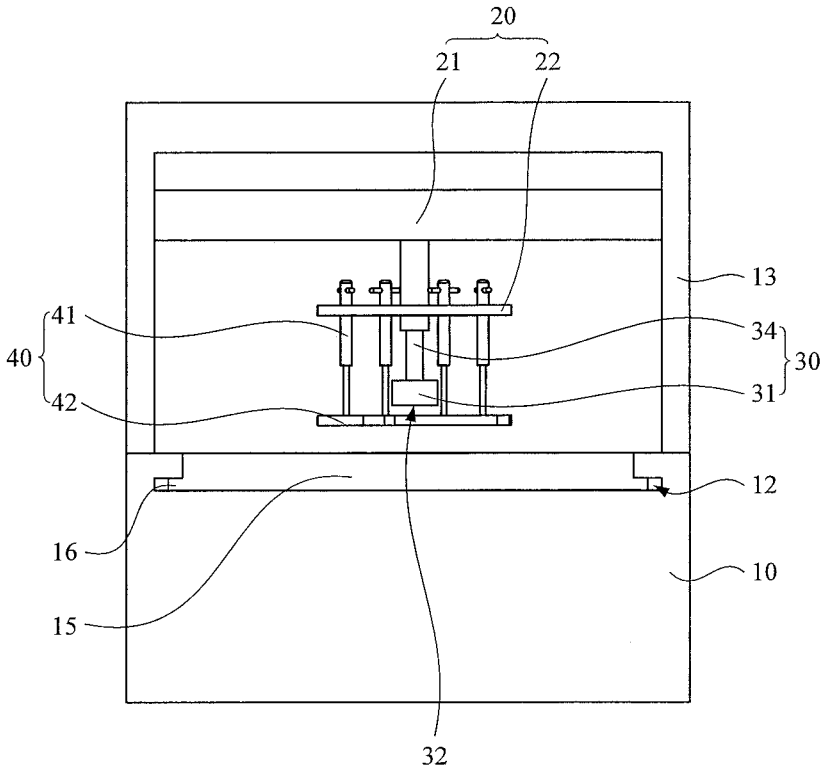
FIG. 2 is an illustrative view of FIG. 1 when viewed in the direction indicated by arrow A.
Figure 3:
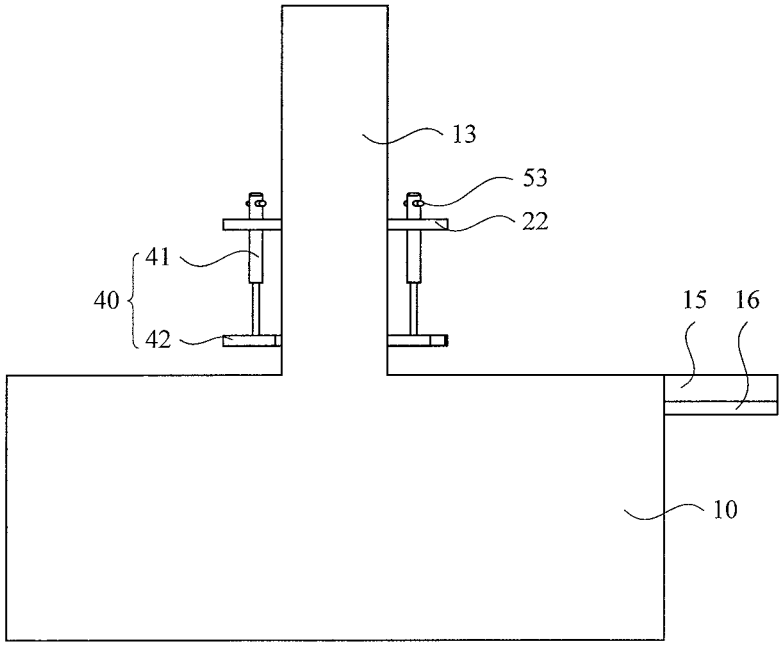
FIG. 3 is an illustrative view of FIG. 1 when viewed in the direction indicated by arrow B.
Figure 4:
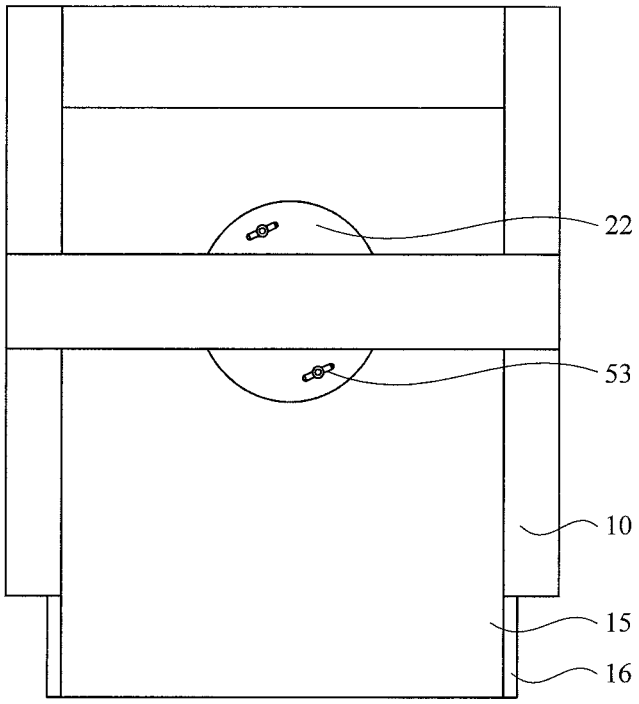
FIG. 4 is an illustrative view of FIG. 1 when viewed in the direction indicated by arrow C.

In an example, the upper surface of the carrying platform 10 is a horizontal surface, and the upper surface of the carrying platform 10 has a rectangular shape, up-down guiding pillars 13 are located at two opposite edges of the upper surface of the carrying platform 10. For example, as shown in FIG. 2, a left edge of the upper surface of the carrying platform 10 is provided with a up-down guiding pillar 13, and a right edge of the upper surface of the carrying platform 10 is provided with another up-down guiding pillar 13, and the two up-down guiding pillars 13 are disposed facing one another. In other words, two opposite up-down guiding pillars 13 are disposed respectively at two opposite edges of the upper surface of the carrying platform 10; each of the two up-down guiding pillars 13 is provided with the vertical slideway 14 or lifting rail in the length direction of the up-down guiding pillars 13, each of two ends of the supporting beam 21 is provided with a slider mounted within a corresponding vertical slideway 14 or on a corresponding lifting rail; the supporting beam 21 is connected with a driving device for driving the supporting beam 21 upwards or downwards in the length direction of the up-down guiding pillars 13. Compared with only one up-down guiding pillar being provided, the two up-down guiding pillars 13 provided at the edges of the upper surface of the carrying platform 10 may prevent vibration of the supporting beam 21 when it moves upwards or downwards in the length direction of the up-down guiding pillars 13, so that reliability and stability of the lifting platform 20 when it moves upwards or downwards in the length direction of the up-down guiding pillars 13 can be improved.

Still referring to FIGS. 1 and 2, in the embodiment of the present disclosure, the grinding head 30 is slidably mounted to the supporting beam 21, i.e., the grinding head 30 may move in a length direction of the supporting beam 21. In practice, the supporting beam 21 may be provided with a transverse slideway arranged in the length direction of the supporting beam 21, and the grinding head 30 may be provided with a transverse slider mating with the transverse slideway. As shown in FIG. 2, for example, the length direction of the supporting beam 21 is the left-and-right direction, the supporting beam 21 is provided with a transverse slideway, and the grinding head 30 is provided with a transverse slider mating with the transverse slideway, such that the grinding head 30 may move reciprocatively in the left-and-right direction. In practice, the grinding head 30 may be moved in the length direction of the supporting beam 21 to adjust the position of the grinding head 30, such that the grinding surface 32 of the grinding head 30 is aligned with the grind region of the substrate to be ground, and thereby adjusting position of the grinding head 30 to align the grinding surface 32 of the grinding head 30 with the grind region of the substrate to be ground is facilitated, and alignment accuracy between the grinding surface 32 of the grinding head 30 and the grind region of the substrate to be ground is improved.

In order to further improve alignment accuracy between the grinding surface 32 of the grinding head 30 and the grind region of the substrate to be ground, in the embodiment shown in FIG. 1, the substrate grinding device further includes a carrying plate 15 mounted slidably relative to the carrying platform 10, and the substrate to be ground is laid on an upper surface of the carrying plate 15. The carrying plate 15 may be mounted slidably through various different ways. For example, the carrying platform 10 may be provided with a guiding groove, such as, groove 11, an extension direction of the groove 11 is in parallel with the upper surface of the carrying platform 10, and the extension direction of the groove 11 is not in parallel with the length direction of the supporting beam 21; the carrying plate may be slidably mounted into the groove 11.

For example, the length direction of the supporting beam 21 is the left-and-right direction shown in FIG. 2, the grinding head 30 may slide in the length direction of the supporting beam 21. In other words, the grinding head 30 may slide in the left-and-right direction shown in FIG. 2; the carrying platform 10 is provided with a groove 11 extending in a direction perpendicular to the length direction of the supporting beam 21 and parallel with the upper surface of the carrying platform 10. In other words, the extension direction of the groove 11 is perpendicular to the length direction of the supporting beam 21 and parallel with the upper surface of the carrying platform 10, i.e., the fore-and-aft direction shown in FIG. 2. The groove 11 is provided within the carrying platform 10 and opens to the upper surface of the carrying platform 10; the carrying platform 10 includes the carrying plate 15 inside the groove 11, and the upper surface of the carrying plate 15 is in parallel with the upper surface of the carrying platform 10, and the carrying plate 15 may slide along the extension direction of the groove 11. As shown in FIG. 1, for example, the upper surface of the carrying platform 10 is rectangular, and the groove 11 is provided in the carrying platform 10 and passes through the carrying platform 10 from its front side to its rear side; the groove 11 opens to the upper surface of the carrying platform 10, and the extension direction of the groove 11 is perpendicular to the length direction of the supporting beam 21 and parallel with the upper surface of the carrying platform 10; each of two sidewalls of the groove 11 is provided with a longitudinal slideway 12 concaved towards the inside of the carrying platform 10; the longitudinal slideway 12 passes through the carrying platform 10 from its front side to its rear side, i.e., an extension direction of the longitudinal slideway 12 is the same as the extension direction of the groove 11; a cross section of the carrying plate 15 is substantially rectangular and each of two opposite sides of the carrying plate 15 is provided with a longitudinal protrusion 16 mating with a corresponding longitudinal slideway 12.

In use, firstly, the substrate to be ground may be placed on the upper surface of the carrying plate 15, then the two longitudinal protrusions 16 of the carrying plate 15 are inserted into corresponding longitudinal slideways 12, and then the carrying plate 15 is moved, such that the substrate to be ground placed on the upper surface of the carrying plate is moved to be located underneath the grinding head 30; then the grinding head 30 is moved in the length direction of the supporting beam 21 and the carrying plate 15 is moved in the extension direction of the longitudinal slideway 12, so as to adjust a position of the grinding head 30 in the left-and-right direction shown in FIG. 2 and a position of the substrate to be ground in the fore-and-aft direction shown in FIG. 2, such that the grind region of the substrate to be ground is aligned with the grinding surface 32 of the grinding head 30; then the supporting beam 21 moves towards the carrying platform 10 in the length direction of the up-down guiding pillars 13, such that the grinding head 30 is moved towards the carrying platform 10, and when the grinding surface 32 of the grinding head 30 contacts the grind region of the substrate to be ground, the supporting beam 21 stops moving; then the grinding head 30 is used to grind the grind region of the substrate to remove partial scratch in the surface of the substrate.

Since the upper surface of the carrying platform 10 is provided with the carrying plate 15, and the carrying plate 15 may slide in a direction perpendicular to the length direction of the supporting beam 21 on the upper surface of the carrying platform 10, the substrate grinding device according to the embodiment of the present disclosure may adjust the relative position between the grind region of the substrate to be ground and the grinding surface 32 of the grinding head 30, such that the grind region of the substrate to be ground is aligned with the grinding surface 32 of the grinding head 30, and thereby alignment accuracy between the grinding surface 32 of the grinding head 30 and the grind region of the substrate to be ground is further improved.

In the above embodiment, the extension direction of the groove 11 is perpendicular to the length direction of the supporting beam 21. However, in practice, the embodiment may be implemented as long as the extension direction of the groove 11 is not in parallel with the length direction of the supporting beam 21. In other words, the extension direction of the groove 11 is at a certain angle to the length direction of the supporting beam 21. For example, the angle between the extension direction of the groove 11 and the length direction of the supporting beam 21 is 30 degrees, 45 degrees or 60 degrees.

To be noted, when the substrate grinding device according to the embodiment of the present disclosure is utilized to remove partial scratches in the surface of the substrate to be ground, the process may includes: firstly, placing the substrate to be ground on the upper surface of the carrying plate 15, inserting the two longitudinal protrusions 16 of the carrying plate 15 into corresponding longitudinal slideways 12, and moving the carrying plate 15 such that the substrate to be ground placed on the upper surface of the carrying plate 15 is moved to be located underneath the grinding head 30; then, moving the supporting beam 21 in the length direction of the supporting pillars 30 towards the carrying platform 10 by a certain distance such that the grinding head 30 is moved towards the carrying platform 10 by the certain distance and the grinding surface 32 of the grinding head 30 does not contact the grind region of the substrate to be ground; then, moving the grinding head 30 in the length direction of the supporting beam 21 and moving the carrying plate 15 in the extension direction of the longitudinal slideway 12 to adjust the position of the grinding head 30 in the left-and-right direction shown in FIG. 2 and the position of the substrate to be ground in the fore-and-aft direction shown in FIG. 2, such that the grind region of the substrate to be ground is aligned with the grinding surface 32 of the grinding head 30; then, moving the supporting beam 21 towards the carrying platform 10 in the length direction of the up-down guiding pillars 13, such that the grinding head 30 is moved towards the carrying platform 10; then, stopping moving the supporting beam 21 when the grinding surface 32 of the grinding head 30 contacts the grind region of the substrate to be ground; then, using the grinding head 30 to grind the grind region of the substrate to remove partial scratch in the surface of the substrate.

In the above embodiment, after being placed on the upper surface of the carrying platform 10, the substrate to be ground may be fixed in various different manners. For example, the carrying platform 10 may be provided with a vacuum suction hole which opens at the upper surface of the carrying platform 10, and the vacuum suction hole is communicated with a vacuum generator. During use, after the substrate to be ground has been placed on the upper surface of the carrying platform 10, the vacuum generator is started to suck the substrate to be ground to the upper surface of the carrying platform 10 such that the substrate to be ground is fixed. Alternatively, the carrying platform 10 may be provided with a plurality of clampers disposed around the upper surface of the carrying platform 10, and during use, after the substrate to be ground has been placed on the upper surface of the carrying platform 10, the plurality of clampers will fix the substrate to be ground to the upper surface of the carrying platform 10.

Still referring to FIGS. 1 and 2, in the embodiment of the present disclosure, the substrate grinding device further includes a pressing head 40 mounted to the lifting platform 20. The grinding head 30 moves along with the lifting platform 20 towards the carrying platform 10, and when the grinding head 30 contacts the grind region of the substrate to be ground, the pressing head 40 presses the substrate to be ground firmly on upper surface of the carrying platform 10. For example, the upper surface of the carrying platform 10 is rectangular, the up-down guiding pillars 13 are located at two opposite edges of the upper surface of the carrying platform 10; the lifting platform 20 includes the supporting beam 21 and two ends of the supporting beam 21 are mounted to the corresponding guiding pillars 13 respectively; the grinding head 30 and the pressing head 40 are mounted to the supporting beam 21 respectively. In use, firstly, the substrate to be ground may be placed on the upper surface of the carrying platform 10, and relative position between the grinding surface 32 of the grinding head 30 and the grind region of the substrate to be ground is adjusted, such that the grinding surface 32 of the grinding head 30 is aligned with the grind region of the substrate to be ground; then, the supporting beam 21 is moved in the length direction of the up-down guiding pillars 13 towards the carrying platform 10 such that the grinding head 30 and the pressing head 40 are moved in the length direction of the up-down guiding pillars 13 towards the carrying platform 10, and when the grinding surface 32 of the grinding head 30 contacts the grind region of the substrate to be ground, the supporting beam 21 stops moving, and at this time, the pressing head 40 presses the substrate to be ground firmly on the upper surface of the carrying platform 10.

Still referring to FIGS. 1 to 4, according to the embodiment of the present disclosure, the lifting platform 20 may include a mounting plate 22, to which the grinding head 30 and the pressing head 40 are mounted separately. The grinding head 30 is located at a central part of the mounting plate 22, and the pressing head 40 is located at edge regions of the mounting plate 22. For example, the lifting platform 20 includes the supporting beam 21 and the mounting plate 22, the mounting plate 22 is slidably mounted to the supporting beam 21, the mounting plate 22 may slide in the length direction of the supporting beam 21, and the mounting plate 22 has a disc-shaped structure. Each of the grinding head 30 and the pressing head 40 is mounted below the mounting plate 22, the grinding head 30 is located at the central part of the mounting plate 22, and the pressing head 40 is located at edge regions of the mounting plate 22. In use, the supporting beam 21 is moved upwards or downwards in the direction perpendicular to the upper surface of the carrying platform 10, thus, the mounting plate 22, the grinding head 30 and the pressing head 40 are moved upwards or downwards in the direction perpendicular to the upper surface of the carrying platform 10, and when the grinding surface 32 of the grinding head 30 contacts the grind region of the substrate to be ground, the supporting beam 21 stops moving, the pressing head 40 presses the substrate to be ground at regions adjacent to the grind region, so as to firmly press the substrate on the upper surface of the carrying platform 10.

Each of the grinding head 30 and the pressing head 40 is mounted to the mounting plate 22, such that when the mounting plate 22 moves in the length direction of the supporting beam 21, the grinding head 30 and the pressing head 40 are moved in the length direction of the supporting beam 21 at the same time. Since the grinding head 30 is located at the center of the mounting plate 22 and the pressing head 40 is located at edge regions of the mounting plate 22, regions of the substrate to be ground contacting the pressing head 40 will always be located around the grind region of the substrate to be ground, when the pressing head 40 presses the substrate to be ground firmly on the upper surface of the carrying platform 10, such that uneven pressure applied to the grind region caused by peripheral regions of the grind region of the substrate to be ground not being firmly pressed may be prevented, and thereby accuracy and evenness of the grinding process performed on the grind region of the substrate may be improved.

In the above embodiment, there may be one, two or more pressing heads 40. Still referring to FIGS. 1 and 2, in the embodiment of the present disclosure, the number of the pressing heads 40 is four, and the four pressing heads 40 are uniformly distributed along the edge of the mounting plate 22. As shown in FIG. 1, the mounting plate 22 has a disc-shaped structure and is mounted slidably to the supporting beam 21, and the mounting plate 22 may slide in the length direction of the supporting beam 21. The grinding head 30 and the four pressing heads 40 are mounted below the mounting plate 22, where the grinding head 30 is located at the central part of the mounting plate 22, and the four pressing heads 40 are located at edge regions of the mounting plate 22. The four pressing heads 40 are uniformly distributed along the edge of the mounting plate 22. The four pressing heads 40 are uniformly distributed around the grinding head 30, which may improve accuracy and evenness of pressure applied on a peripheral region of the grind region of the substrate, thereby preventing the substrate being damaged due to uneven pressure.

Figure 5:
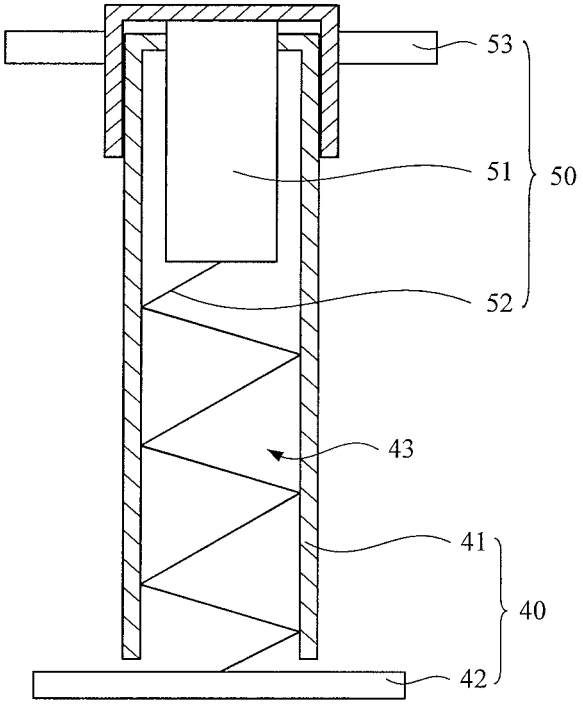
FIG. 5 is an illustrative view showing a structure of a pressing head of the substrate grinding device according to an exemplary embodiment of the present disclosure.

Referring to FIGS. 1 and 5, in the embodiment of the present disclosure, the pressing head 40 includes a pressing head supporting pillar 41 mounted to the lifting platform 20, a pressing plate 42 located underneath the pressing head supporting pillar 41 and a pressure adjusting member 50 mounted to the pressing head supporting pillar 41 and configured for adjusting a pressure applied by the pressing plate 42 to the substrate to be ground. As shown in the figures, the number of the pressing heads 40 is four, the grinding head 30 and the four pressing heads 40 are mounted to the mounting plate 22, each pressing head 40 includes a pressing head supporting pillar 41 mounted to the mounting plate 22 and a pressing plate 42 located underneath the pressing head supporting pillar 41, and the pressing plate 25 may contact and press the substrate to be ground firmly on the upper surface of the carrying platform 10. In use, the supporting beam 21 is moved upwards or downwards in the direction perpendicular to the upper surface of the carrying platform 10, thus, the mounting plate 22, the grinding head 30 and the four pressing heads 40 are moved upwards or downwards in the direction perpendicular to the upper surface of the carrying platform 10, and when the grinding surface 32 of the grinding head 30 contacts the grind region of the substrate to be ground, the supporting beam 21 stops moving, then the pressure adjusting member 50 of the pressing head supporting pillar 41 of each of the pressing heads 40 is adjusted to adjust the pressure applied by the pressing plate 42 of each pressing head 40 to the substrate to be ground, such that evenness of pressure applied on the peripheral region of the grind region of the substrate to be ground may be improved, and the pressure applied by the pressing plate 42 of each pressing head 40 on the substrate to be ground may be proper and thereby the substrate to be ground may be prevented from being damaged due to improper pressure applied thereon by the pressing plate 42.

Additionally, each of the pressing heads 40 includes the pressure adjusting member 50 provided on the pressing head supporting pillar 41 and configured for adjusting the pressure applied by the pressing plate 42 on the substrate to be ground, such that a grind region of a display substrate that has already been assembled can be grounded. If the grind region of the display substrate is located at an edge of the display substrate adjacent to a printed circuit board, when the pressing head 40 firmly presses the display substrate on the upper surface of the carrying platform 10, one or two of the pressing heads 40 of the pressing plate 42 may contact the printed circuit board. In order to avoid the interference of the pressing plate 42 of the pressing head 40 to the printed circuit board, the pressure adjusting member 50 provided on the pressing head supporting pillar 41 of the pressing head 40 that may contact the printed circuit board may be adjusted, such that corresponding pressing plate(s) 42 do not contact the printed circuit board, thus, interference of the pressing plate 42 of the pressing head 40 to the printed circuit board may be avoided.

In the embodiment, adjusting the pressure applied by the pressing plate 42 to the substrate to be ground through the pressure adjusting member 50 may be realized in many ways. For example, the pressing head supporting pillar 41 may include a telescopic structure having a plurality of cylindrical rods. An outer surface of each rod is provided with external threads, and in two adjacent rods, one rod having a larger outer diameter is provide with a receiving hole for receiving the other rod having a smaller outer diameter. A wall of the receiving hole is provided with internal threads mating with the outer thread of the rod having the smaller outer diameter. One end of the pressing head supporting pillar 41 is fixed with the pressing plate 42, and the other end is inserted into a sleeve having internal threads, and the pressure adjusting member 50 includes the sleeve having internal threads. In use, the sleeve is rotated, such that the pressing head supporting pillar 41 extends or retracts to adjust the pressure applied by the pressing plate 42 on the substrate to be ground.

Still referring to FIG. 5, in the embodiment of the present disclosure, the pressing head supporting pillar 41 is provide therein with a receiving cavity 43 extending in the length direction of the pressing head supporting pillar 41; the pressure adjusting member 50 includes an elastic member 52, a compressing column 51 and an adjusting knob 53, where the elastic member 52 and the compressing column 51 are disposed within the receiving cavity 43, one end of the elastic member 52 is connected with the pressing plate 42, and the other end of the elastic member 52 is connected with the compressing column 51; the compressing column 51 is connected with the adjusting knob 53, and the compressing column 51 may be configured to slide in the length direction of the pressing head supporting pillar 41 by rotating the adjusting knob 53. For example, the pressing head supporting pillar 41 has a cylindrical shape, the pressing head supporting pillar 41 is provided therein with the receiving cavity 43 extending in an axial direction of the pressing head supporting pillar 41, and the outer peripheral surface of the pressing head supporting pillar 41 is provided with external threads; the elastic member 52 and the compressing column 51 are disposed within the receiving cavity 43, the elastic member 52 is located below the compressing column 51, one end of the elastic member 52 is connected with the pressing plate 42, and the other end of the elastic member 52 is connected with the compressing column 51; the adjusting knob 53 includes a sleeve surrounding the outer peripheral surface of the pressing head supporting pillar 41, and inner peripheral surface of the sleeve is provided with internal threads mating with the external threads on the outer peripheral surface of the pressing head supporting pillar 41; and the compressing column 51 is fixedly connected to the sleeve. The elastic member 52 may be a spring.

In use, the sleeve of the adjusting knob 53 is rotated, moving the compressing column 51 in the length direction of the pressing head supporting pillar 41 within the receiving cavity 43, so as to compress or loosen the elastic member 52, and under the action of the elastic member 52, the pressure applied by the pressing plate 42 on the substrate to be ground may be adjusted.

In the embodiment, for example, a buffer layer may be provided on the surface of the pressing plate 42 to be contacted by the substrate to be ground. In other words, the lower surface of the pressing plate 42 may be provided with a buffer layer. The buffer layer enables a non-rigid contact between the pressing plate 42 and the substrate to be ground, such that damage of the substrate to be ground caused by rigid contact between the pressing plate 42 and the substrate to be ground may be prevented. The buffer layer may be a rubber buffer layer or a flannel buffer layer.

When the substrate grinding device according to the above embodiment is utilized to remove a partial scratch on a surface of a substrate to be ground, abrasive usually needs to be provided between the grinding head 30 and the grind region of the substrate. In other words, a wet grinding is performed when the grind region of the substrate is ground by the grinding head 30, so as to prevent the substrate from being damaged when the grind region of the substrate is ground by dry grinding. Adding abrasive between the grinding head 30 and the grind region of the substrate to be ground may be performed manually or automatically. In the embodiment of the present disclosure, adding abrasive between the grinding head 30 and the grind region of the substrate to be ground is performed automatically, and an exemplary process may be as follows.

Figure 6:
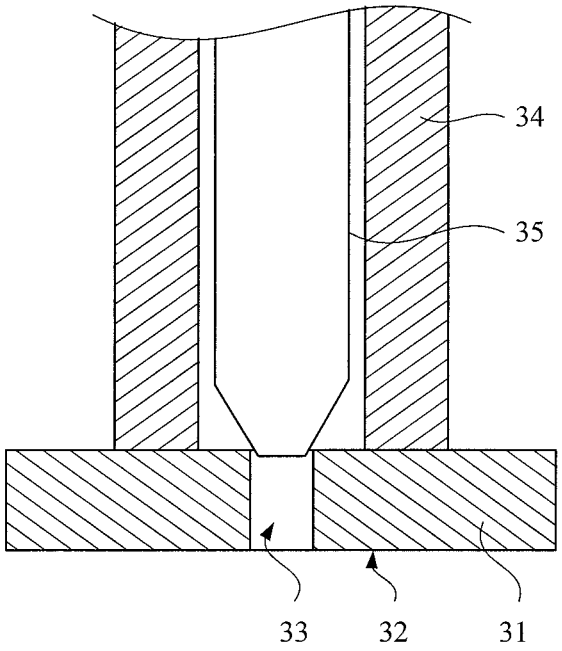
FIG. 6 is an illustrative view showing a structure of a grinding head of the substrate grinding device according to an exemplary embodiment of the present disclosure.

Referring to FIGS. 1 and 6, the grinding head 30 includes a body 31 of the grinding head 31 and a grinding head supporting pillar 34; one end of the grinding head supporting pillar 34 is connected with the body 31 of the grinding head 31, and the other end of the grinding head supporting pillar 34 is mounted to the lifting platform 20; the body 31 is connected with a driving device for the grinding head, the driving device drives the body 31 of the grinding head to grind the grind region of the substrate; the grinding head supporting pillar 34 is provided therein with an abrasive pipe 35; the body 31 of the grinding head is provided with a through hole 33, one end of the through hole 33 communicates with an exit of the abrasive pipe 35, and the other end of the through hole 33 opens at the grinding surface 32 of the body 31 of the grinding head.

In an example, the grinding head 30 includes the body 31 and the grinding head supporting pillar 34, the body 31 has a cylindrical shape, one end surface of the cylindrical body is the grinding surface 32, and the grinding surface 32 faces the carrying platform 10, the other end surface of the body is connected with one end of the grinding head supporting pillar 34, the other end of the grinding head supporting pillar 34 is connected with the mounting plate 22; the grinding head supporting pillar 34 is provided therein with an abrasive pipe 35 into which the abrasive may be charged; the cylindrical body of the grinding head is provided therein with the through hole 33 extending in the axial direction of the cylindrical body; as shown in FIG. 6, the upper end of the through hole 33 communicates with the abrasive pipe 35, and the lower end of the through hole 33 opens at the grinding surface 32. In use, abrasive is charged into the through hole 33 inside the body 31 via the abrasive pipe 35, then flows onto the surface of the substrate to be ground via the through hole 33 and fills the space between the grind region of the substrate to be ground and the grinding surface 32 of the body 31 of the grinding head, so as to prevent the substrate from being damaged when the grind region of the substrate is ground by dry grinding. The abrasive may be water or a grinding fluid formed of a mixture of water, abrasive paste, abrasive powders and the like.

The cross section of the through hole 32 may have various shapes, such as triangular, rectangular, polygonal, circular or the like. In the embodiment, the cross section of the through hole 32 is circular, i.e., the through hole 32 is a cylindrical through hole, and a diameter of the cylindrical through hole is in a range of 1.5 mm to 3 mm, such as, 1.5 mm, 2 mm or 3 mm. Setting the diameter of the cylindrical through hole to be in the range of 1.5 to 3 mm may prevent an effective area of the grinding surface 32 from being excessively reduced due to an overlarge diameter of the cylindrical through hole, and avoid an unsmooth flow of abrasive caused by an excessively small diameter of the cylindrical through hole. Specific features, structures, materials and characteristics in the embodiments described above may be combined in any suitable manner to form one or more other embodiments.

The above disclosed embodiments are exemplary implementations of the present disclosure, while the scope of the present disclosure is not limited thereto. Any changes or modifications made by an ordinary skilled in the art without departing from the principles and spirit of the disclosure shall fall within the scope of the disclosure. Thus, the scope of the present disclosure should be determined by the claims and equivalents thereof.

What is claimed is:

1. A substrate grinding device, comprising:

a carrying platform;

a lifting platform located above the carrying platform and configured to be movable in a direction perpendicular to an upper surface of the carrying platform upwardly or downwardly;

a grinding head mounted to the lifting platform and configured to grind a grind region of a substrate to be ground disposed on the upper surface of the carrying platform, the grind region being a region of the substrate where there is a partial scratch; and a pressing head mounted to the lifting platform, wherein the grinding head is configured to move towards the carrying platform along with the lifting platform, and the pressing head is configured to press the substrate firmly against the upper surface of the carrying platform when the grinding head contacts the grind region of the substrate.

2. The substrate grinding device according to claim 1, further comprising an up-down guiding pillar provided at an edge of the upper surface of the carrying platform and perpendicular to the upper surface of the carrying platform, wherein the lifting platform is mounted on the up-down guiding pillar and configured to be movable in a length direction of the up-down guiding pillar upwardly or downwardly.

3. The substrate grinding device according to claim 2, wherein the upper surface of the carrying platform has a rectangular shape, the number of the up-down guiding pillar is two, and the two up-down guiding pillars are located at two opposite edges of the upper surface of the carrying platform respectively; and wherein the lifting platform comprises a supporting beam, to which the grinding head is mounted; two opposite ends of the supporting beam are mounted to the two up-down guiding pillars respectively, and the supporting beam is connected with a driving device configured for driving the supporting beam to move upwards or downwards in the length direction of the up-down guiding pillars.

4. The substrate grinding device according to claim 3, wherein the grinding head is slidably mounted to the supporting beam.

5. The substrate grinding device according to claim 3, wherein the substrate grinding device further comprises a carrying plate for carrying the substrate, the carrying plate is configured to be movable with respect to the carrying platform in a direction parallel to the upper surface of the carrying platform and non-parallel to an extending direction of the supporting beam.

6. The substrate grinding device according to claim 1, wherein the lifting platform comprises a mounting plate to which the grinding head and the pressing head are both mounted, the grinding head is located at a central portion of the mounting plate, and the pressing head is located at an edge portion of the mounting plate.

7. The substrate grinding device according to claim 6, wherein the number of the pressing head is four, and the four pressing heads are distributed uniformly at the edge portion of the mounting plate.

8. The substrate grinding device according to claim 1, wherein the pressing head comprises:

a pressing head supporting pillar mounted to the lifting platform;

a pressing plate disposed under the pressing head supporting pillar; and a pressure adjusting member configured for adjusting a pressure applied by the pressing plate onto the substrate.

9. The substrate grinding device according to claim 8, wherein the pressing head supporting pillar is provided therein with a receiving cavity extending in a length direction of the pressing head supporting pillar;

wherein the pressure adjusting member comprises an elastic member, a compressing column and an adjusting knob, the elastic member and the compressing column are received within the receiving cavity, one end of the elastic member is connected with the pressing plate, the other end of the elastic member is connected with the compressing column; the compressing column is connected with the adjusting knob, and the compressing column is configured to be slidable within the receiving cavity in the length direction of the pressing head supporting pillar by rotating the adjusting knob.

10. The substrate grinding device according to claim 8, wherein a surface of the pressing plate contacting the substrate is provided with a buffer layer.

11. The substrate grinding device according to claim 1, wherein the grinding head comprises a body and a grinding head supporting pillar, one end of the grinding head supporting pillar is connected with the body of the grinding head, and the other end of the grinding head supporting pillar is mounted to the lifting platform; wherein the body of the grinding head is connected with a grinding head driving device configured to drive the body of the grinding head to grind the grind region of the substrate.

12. The substrate grinding device according to claim 11, wherein the grinding head supporting pillar is provided therein with an abrasive pipe, the body of the grinding head is provided therein with a through hole, one end of the through hole is communicated with an exit of the abrasive pipe, and the other end of the through hole is opened at a grinding surface of the body of the grinding head.

13. The substrate grinding device according to claim 12, wherein the through hole is a cylindrical through hole having a diameter of 1.5 mm to 3 mm.

* * * * *